US006516566B2

(12) United States Patent
Finke

(10) Patent No.: US 6,516,566 B2
(45) Date of Patent: Feb. 11, 2003

(54) AUTOMATIC MOVABLE PARTITION SYSTEM HOUSING HAVING A STRENGTHENING SUPPORT LEG

(75) Inventor: Andreas Finke, Gevelsberg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/745,069

(22) Filed: Dec. 20, 2000

(65) Prior Publication Data

US 2001/0037605 A1 Nov. 8, 2001

(30) Foreign Application Priority Data

Dec. 21, 1999 (DE) ..... 199 62 074

(51) Int. Cl.[7] ..... E05D 15/36
(52) U.S. Cl. ..... 49/127; 49/130; 49/409
(58) Field of Search ..... 49/125, 127, 128, 49/129, 130, 409, 413; 16/87.4 R, 95 R

(56) References Cited

U.S. PATENT DOCUMENTS

| | | | | | |
|---|---|---|---|---|---|
| 3,309,816 | A | * | 3/1967 | Malone | 49/127 |
| 3,473,266 | A | | 10/1969 | Miller | |
| 3,925,933 | A | * | 12/1975 | Reuter | 49/409 |
| 5,048,196 | A | * | 9/1991 | Bernd et al. | 33/734 |
| 5,450,693 | A | * | 9/1995 | Tarrega | 49/411 |
| 6,026,612 | A | * | 2/2000 | Strassel et al. | 49/425 |
| 6,058,656 | A | * | 5/2000 | Bischof et al. | 49/409 |
| 6,082,053 | A | * | 7/2000 | Bischof et al. | 52/64 |
| 6,098,342 | A | * | 8/2000 | Bischof et al. | 49/409 |
| 6,233,878 | B1 | * | 5/2001 | Krahenbuhl et al. | 52/64 |

FOREIGN PATENT DOCUMENTS

| | | | | |
|---|---|---|---|---|
| DE | 3602567 | * | 7/1987 | 49/409 |
| DE | 19804860 | | 8/1999 | |
| EP | 0413881 | * | 2/1991 | 49/409 |
| FR | 2631072 | * | 11/1989 | 49/409 |

* cited by examiner

*Primary Examiner*—Gregory J. Strimbu
(74) *Attorney, Agent, or Firm*—Nils H. Ljungman & Associates

(57) ABSTRACT

A housing for a movable partition system, which housing is used to house mechanical, electrical and electronic components of the movable partition system. The housing has a one-piece, C-shaped transom profile. The housing further has a support leg which defines a cavity in the interior of the housing. The support leg is designed to maximize stability and torsional stiffness of the housing and to maximize available space in the interior of the housing to house components of the movable partition system.

15 Claims, 7 Drawing Sheets

AUTOMATIC MOVABLE PARTITION SYSTEM HOUSING HAVING A STRENGTHENING SUPPORT LEG

BACKGROUND OF THE INVENTION

1. Field of the Invention

The invention relates to a sliding panel system having panels sliding along at least one slide rail arrangement and movable partition system having a rail, and a rail for a carriage for a movable partition, and a method for use of a movable partition system having a rail, and a partition wall system having a drive mechanism and a housing, in particular for drive systems of automatic and horizontally movable elements and a housing for automatic drive systems. The housing thereby consists essentially of a transom profile and a closing profile located on it.

2. Background of the Invention

Housings of this type are used, for example, in automatic drive systems for sliding doors of all types or horizontally movable elements. DE 198 04 860 C1 describes a housing that consists of a transom profile and a facing that is to be attached to it. The running devices for the movable elements are located inside the housing along with their suspension devices, as well as the drive units such as the motor, drive wheels and deflector pulleys for a toothed belt or chain. The housing can also contain an open-loop or closed-loop control system for the drive motor, which control system can be activated by corresponding sensor signals.

Attempts to develop the smallest possible housings using lightweight materials have resulted in a worsening of the already unfavorable ratio between the length and the cross section of the housing, and thus have thus necessarily led to extremely unstable designs. The handling and installation of the already complicated sheet metal housing is made even more difficult by these unfavorable parameters.

OBJECT OF THE INVENTION

The object of the invention is therefore to eliminate the defects of similar devices of the prior art and thereby create a housing that can hold all of the components for automatically movable elements, and one that can be simplified in terms of the manufacturing and installation work required, whereby the torsional stiffness of the housing is also increased.

SUMMARY OF THE INVENTION

The invention teaches that the object of the invention can be accomplished by the features disclosed as follows: Housing, in particular for automatic drive systems of horizontally movable elements, whereby the housing is used in particular to hold mechanical, electrical and electronic components such as running, devices, suspension devices for movable elements, drive units consisting of power transmission means, coupling, motor and displacement sensing devices, auxiliary drives, open-loop/closed-loop control systems, power supply, sensors etc.

The housing consists essentially of a one-piece C-shaped transom profile and a closing profile which is pivotably fastened to it, whereby the transom profile has a longitudinal leg and transverse or cross legs attached to its ends. Between the longitudinal leg and the lower transverse leg, a support leg is molded on in one piece, forming a cavity. The support leg increases the torsional stiffness of the transom profile and thereby makes the housing significantly easier to handle and install. The transport of the profile is facilitated as early as immediately after the fabrication of the extruded transom profile, because the number and scope of the transport structures can be reduced. During installation, warping that can damage the shape of the housing is effectively eliminated. The support leg is located between the longitudinal leg and the lower transverse leg, because that is where the weight of the movable elements exerts the highest load. The distance of the support leg from the intersection between the longitudinal leg and the lower transverse leg is a parameter that contributes to the increase in stability. To further increase the torsional stiffness, the support leg is realized with a step or steps.

The closing profile is oriented parallel to the longitudinal leg, and is fastened so that it can pivot on the free end of the upper transverse leg. Between the lower portion of the closing profile and the free end of the lower transverse leg, a slot is realized which makes it possible to establish the connection between the devices that are located inside the housing and the movable elements. At various points on the transom profile, there are undercut mounting grooves which are used to fasten the drive units, the running devices or various accessories. On the ends of the transom profile, there are end caps which are installed separately and can be inserted, for example, into the mounting grooves by means of molded-on tabs and then bolted in place. Thus a housing has been created which is hermetically sealed against outside influences. Such housings can be manufactured in the form of extruded light alloy profiles, and can be cut to the desired length appropriate to the drive system.

The housing is fastened by means of the upper transverse leg to a stationary structure using a positive and non-positive connection. For this purpose, the transverse leg is designed so that it provides the appropriate stability. The closing profile is located on the free end of the upper transverse leg, and in particular so that the closing profile is fastened by an interlock so that it can pivot. The interlock is preferably realized on a separate adapter profile which is fastened in a corresponding locking chamber on the free end of the transverse leg. The use of an adapter profile makes it possible to easily adapt the transom profile to local conditions without the need for constructive modifications.

The free end of the lower transverse leg is used to hold a separate running profile or track or track profile, so that it is possible to move the support rollers of the truck of the movable element. The running profile is thereby located on the transverse leg so that it can be removed and replaced as necessary. As a result of this ability to replace the running profile, it is possible to use the appropriate running profile, depending on the type of operation desired, i.e. also depending on the weight of the door panel.

An extension molded onto the support leg has a cross strut which on one hand covers the track rollers, so that no external factors, such as dirt, for example, can interfere with the travel of the track rollers. On the other hand, the cross strut, which utilizes the stepped design of the support leg, forms a channel that is open on one side and in which the electrical lines necessary for the drive system and/or for an open-loop/closed-loop control system can be laid. The channel can be closed by means of a cover, whereby the cover is fastened in a mounting groove that is realized in the cross strut.

Below the lower transverse leg, there is an accessory channel that is open on the bottom and which can be used, for example, to install a bearing for the side piece that must be able to pivot in emergencies. A cover profile is inserted and locked in place as a closing between the accessory channel that consists of two webs. A U-shaped profile can be in contact with an extension of one web, which profile can contain additional accessory devices or equipment such as, for example, a stop to define the maximum deflection of the swinging panel.

In an additional configuration of the housing claimed by the invention, it is possible to install optional or alternate components in or on the housing. Such accessory devices, which can be configured in different ways depending on the individual application, are located so that they can be moved the undercut mounting grooves, and can be secured by corresponding threaded or snap-in elements. These types of attachments have been found to be particularly appropriate, because such mounting grooves are easy to realize during the manufacturing operations, and provide additional stability for the housing. The mounting grooves, which are formed during the extrusion of the profile, also extend over the entire length of the profile, which means that there is extreme flexibility in the positioning of the accessory devices. Conceivable accessory devices include printed circuit boards for the open-loop/closed-loop control systems of the drive system, or additional housing parts such as, for example, covers or partitions between functional areas. A power supply or sensors can also naturally be located inside the housing.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiment which is illustrated schematically in the accompanying drawings, in which.

DESCRIPTION OF THE PREFERRED EMBODIMENTS

Figure 1:
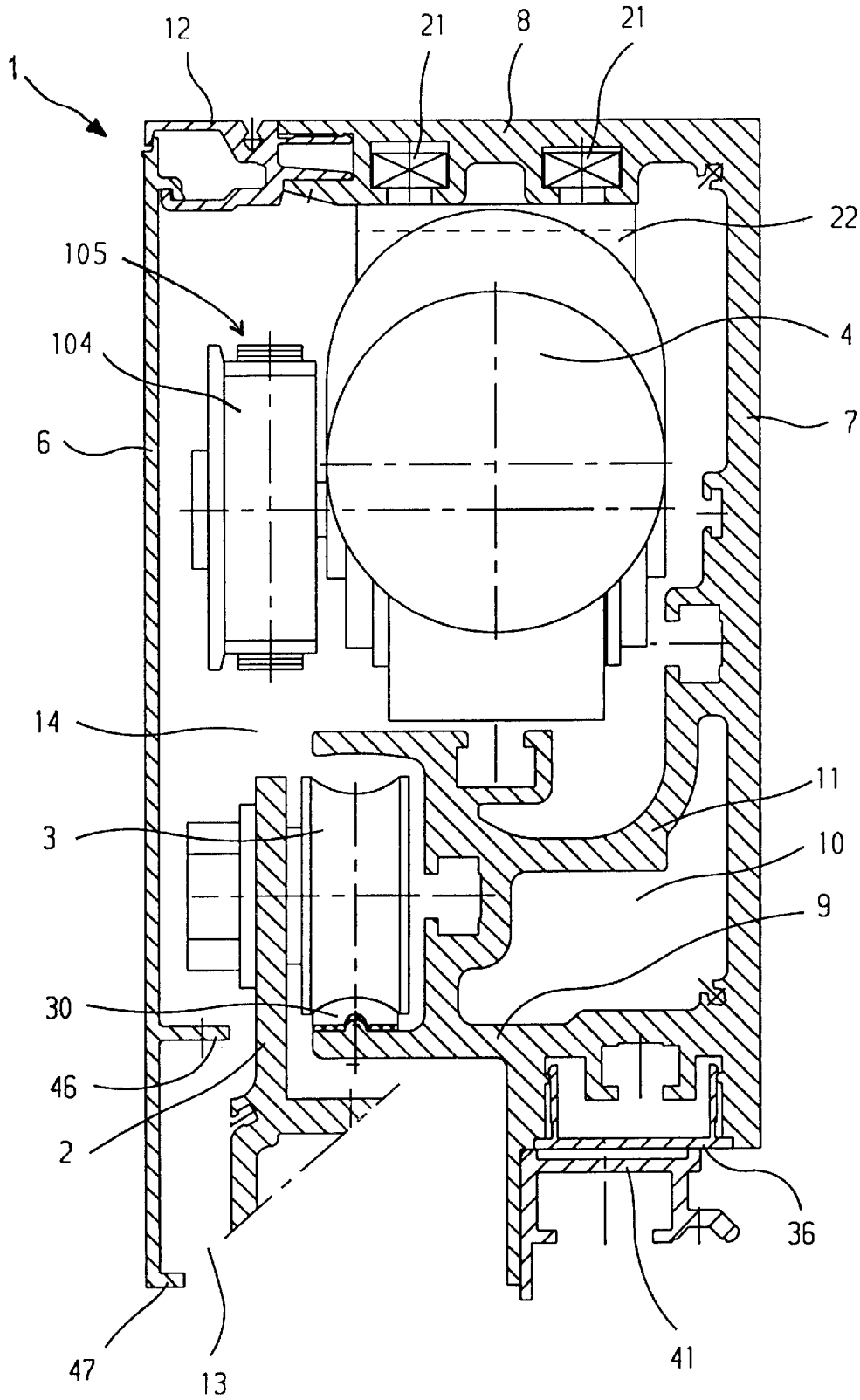
FIG. 1 is a sectional view through a partly equipped housing.

A housing 1, which can be used for a sliding door drive system, for example, whereby individual elements of the door system such as the fixed side pieces and the movable panel are not shown, is illustrated in FIGS. 1 to 4. In this case, the housing 1 is shown in a sectional view at a right angle to the longitudinal direction. In the interest of completeness, it should be noted that such housings 1 can also be used for the drive mechanisms of curved sliding doors, movable partitions and revolving doors, whereby the exemplary embodiment illustrated relates solely and exclusively to the use of the drive mechanism for a sliding door drive system. Inside the housing 1 is a running device for the door panels in the form of a truck 2 with a roller 3 fastened rotationally to it, and a drive unit 4 with a motor, drive wheels and pulleys not illustrated in any further detail for a drive belt or a chain. Inside the housing 1, there is also the open-loop/closed-loop electrical control system (not shown) which is activated by corresponding sensor signals for the drive unit 4.

The housing 1 consists essentially of a C-shaped transom profile 5 and a closing profile 6 fastened pivotably to it, whereby the transom profile has one longitudinal leg 7 and transverse legs 8 and 9 connected at right angles to its ends. The transverse legs 8, 9 are of approximately equal length and are each equal to approximately one-half the length of the longitudinal leg 7. Between the longitudinal leg 7 and the lower transverse leg 9, forming a cavity 10, a support leg 11 is molded in one piece with the rest of the profile. The closing profile 6 is oriented parallel to the longitudinal leg 7 and is fastened by means of an adapter profile 12 to the upper transverse leg 8. Between the closing profile 6 and the lower transverse leg 9, a slot 13 is realized, which makes it possible to connect the running devices 2, 3 that are located in the interior of the housing with the movable elements. At various points on the transom profile 5, there are undercut mounting grooves 15, 16 which are used to fasten the drive unit 4 and various accessories which are not shown in any greater detail. On the ends of the transom profile 5, there are separately installed end caps (not shown), which can be inserted, for example, by means of molded-on tabs into the mounting grooves 15 and then bolted in place. Thus a housing 1 has been created which is hermetically sealed against outside influences. The housing 1 can be manufactured in the form of extruded light alloy profiles, and can be cut to the desired length appropriate to the drive system.

The housing 1 and/or transom profile 5 is fastened by means of the upper transverse leg 8 to a stationary structure, for example a ceiling, a substructure or similar structure, using a positive and non-positive connection. For this purpose, the transverse leg 8 is designed so that it provides the appropriate stability. On its free end, the upper transverse leg 8 has a chamber 17 that is open on one side, in which there is a rib 18 for the locking fastening of the adapter profile 12. Between the chamber 17 and the longitudinal leg 7, there are two mounting grooves 15 that are at some distance from each other in the transverse leg 8, each of which is undercut by facing, hook-like projections 20 that extend into an opening 19. Square-head bolts 21 are located in the two mounting grooves 15 in a positively form-fitting or interlocking manner, to which a mounting bracket 22 of the drive unit 4 is bolted. In the transitional area between the transverse leg 8 and the longitudinal leg 7, on the inside of the housing, there is a circular bolt channel 23, which is used in particular to bolt the end caps in place.

The longitudinal leg 7, approximately halfway between the two transverse legs 8, 9, has two mounting grooves 15, 16 that are located one below the other, the upper mounting groove 16 of which is significantly smaller than all the other mounting grooves 15. On the inside of the housing, in the transitional area between the longitudinal leg 7 and the lower transverse leg 9, there is an additional bolting channel 23. The stepped support leg 11 runs diagonally between the longitudinal leg 7 and the lower transverse leg 9, thereby forming the cavity 10. The support leg 11 is connected flush with the corresponding projection 20 of the mounting groove 15 of the longitudinal leg 7, and makes the transition into a horizontal leg segment 25, forming a shell-shaped channel 24. Electrical lines and devices of the drive system or its control system can be housed in the channel 24. The support leg 11 then makes the transition into a stepped vertical leg segment 26 which is connected to the lower transverse leg 9. The vertical leg segment 26 makes a transition at the interface with the horizontal leg segment 25 into a vertical extension 27 which ends in a cross strut 28 which is extended on both sides. On the right side, the cross strut 28 projects into the channel 24 and represents its lateral wall. In the cross strut 28, there is also an additional mounting groove 15, in which a cover for the channel 24 and/or optional partition elements can be mounted. On the left side, the cross strut 28 runs parallel to the lower transverse leg 9. Between the cross strut 28 and the bottom transverse leg 9, a protected space is thereby created for the travel of the track rollers 3. A rib 29 is realized on the bottom transverse leg 9, so that a running profile can be positively attached there. The running profile 30 is fastened non-positively by means of a clamp (not shown). In the vertical leg segment 26 there is an additional mounting groove 15, in which a limit stop for the horizontal movement of the running device 2, 3 can be mounted.

Figure 2:
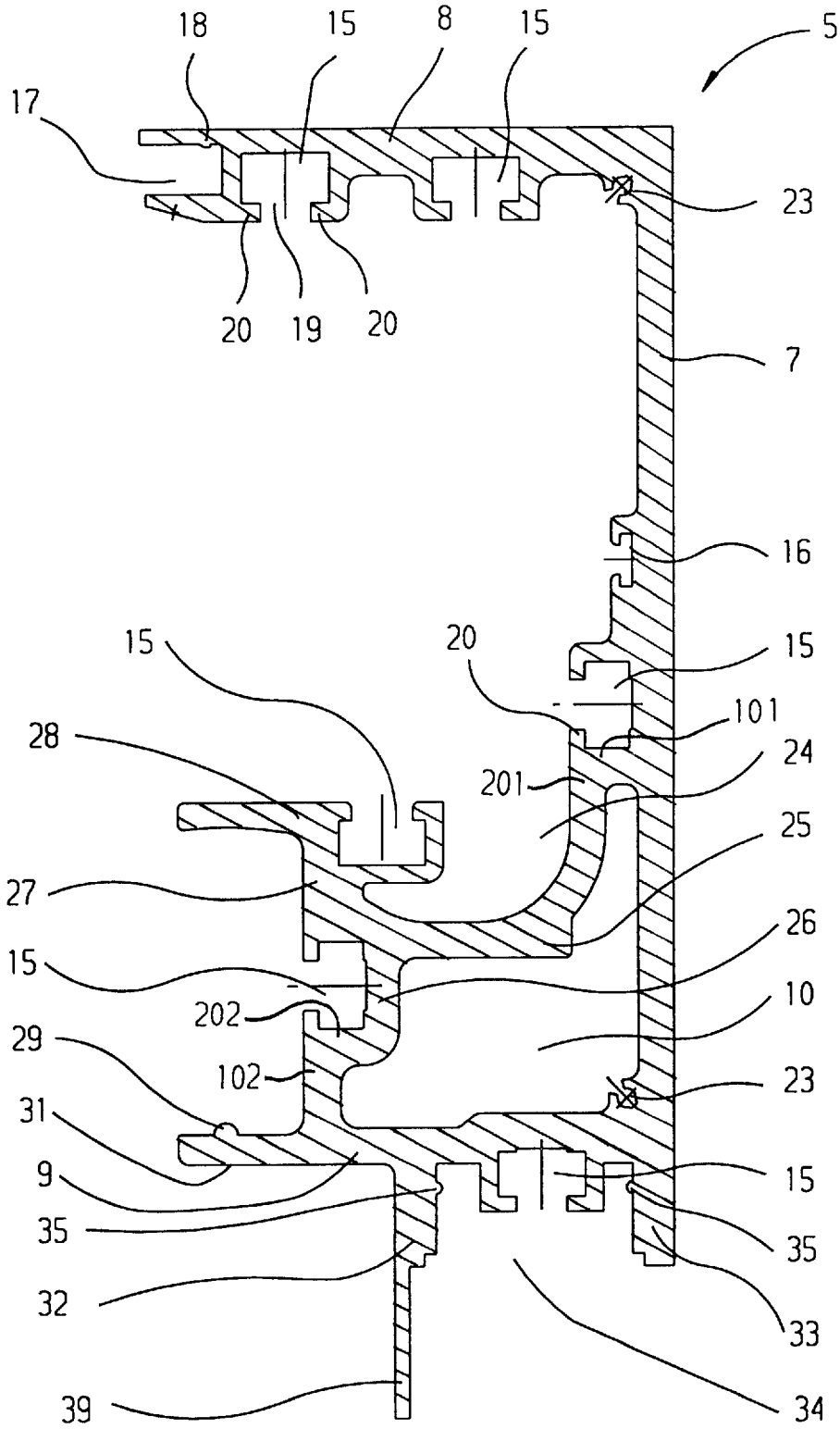
FIG. 2 is a sectional view through an unequipped housing like the one illustrated in FIG. 1.

To further explain, the support leg 11 comprises several sections or portions, as shown in FIG. 2. There are first and second end portions 101 and 102, respectively. There are also a curved, first section 201, the horizontal leg segment or second section 25, the vertical leg segment or third section 26, the fourth section 202, the vertical extension or fifth section 27, and the cross strut or sixth section 28. All of the portions and section each define an individual area of the one-piece support leg 11.

On the underside 31 of the lower transverse leg 9, between two webs 32 and 33, there is an accessory channel 34 that is open on the bottom, for the installation of a bearing for the side piece, which must be able to pivot in emergencies. The bearing is fastened by means of a mounting groove 15 which is realized at this point on the lower transverse leg 9. The web 33 represents a flush elongation of the longitudinal leg 7. On the inside of the webs 32, 33, ribs 35 are formed, onto which a cover profile 36, which is illustrated in greater detail in FIG. 3, can be positively clipped. The cover profile 36 has a cover 37, from which elastically flexible locking arms 38 project at right angles.

The web 32 is elongated by means of a tapered extension 39, so that at this point, a leg 40 of a U-shaped profile 41 is in positive or interlocking contact. Adjacent to the leg 40 at a right angle is a transverse partition 42 and adjacent to that, again at a right angle, an additional leg 43. The U-shaped profile 41 is fastened by means of a threaded connection to the lower transverse leg 9. Between the legs 40 and 43, a stop can be installed to limit the maximum deflection of the swinging panel, whereby inwardly directed edges 44 on the legs 40, 43 guarantee an interlocking connection. An overhang or a projection 45 is also realized on the leg 43.

The closing profile 6 forms the front-side panel of the transom profile 5 and is oriented parallel to the longitudinal leg 7 by means of the adapter profile 12 on the upper transverse leg 8. The connection between the adapter profile 12 and the closing profile 6 is realized so that the closing profile 6 can be pivoted, positioned or even removed, if necessary, for installation of maintenance work, even if the housing is installed in or near the ceiling. The closing profile 6 has two transverse webs 46 and 47, to essentially completely prevent the penetration of foreign objects into the housing 1. The transverse web 46 is located at the level of the lower transverse leg 9, while the transverse web 47 closes the closing profile 6 on the underside.

Figure 1A:
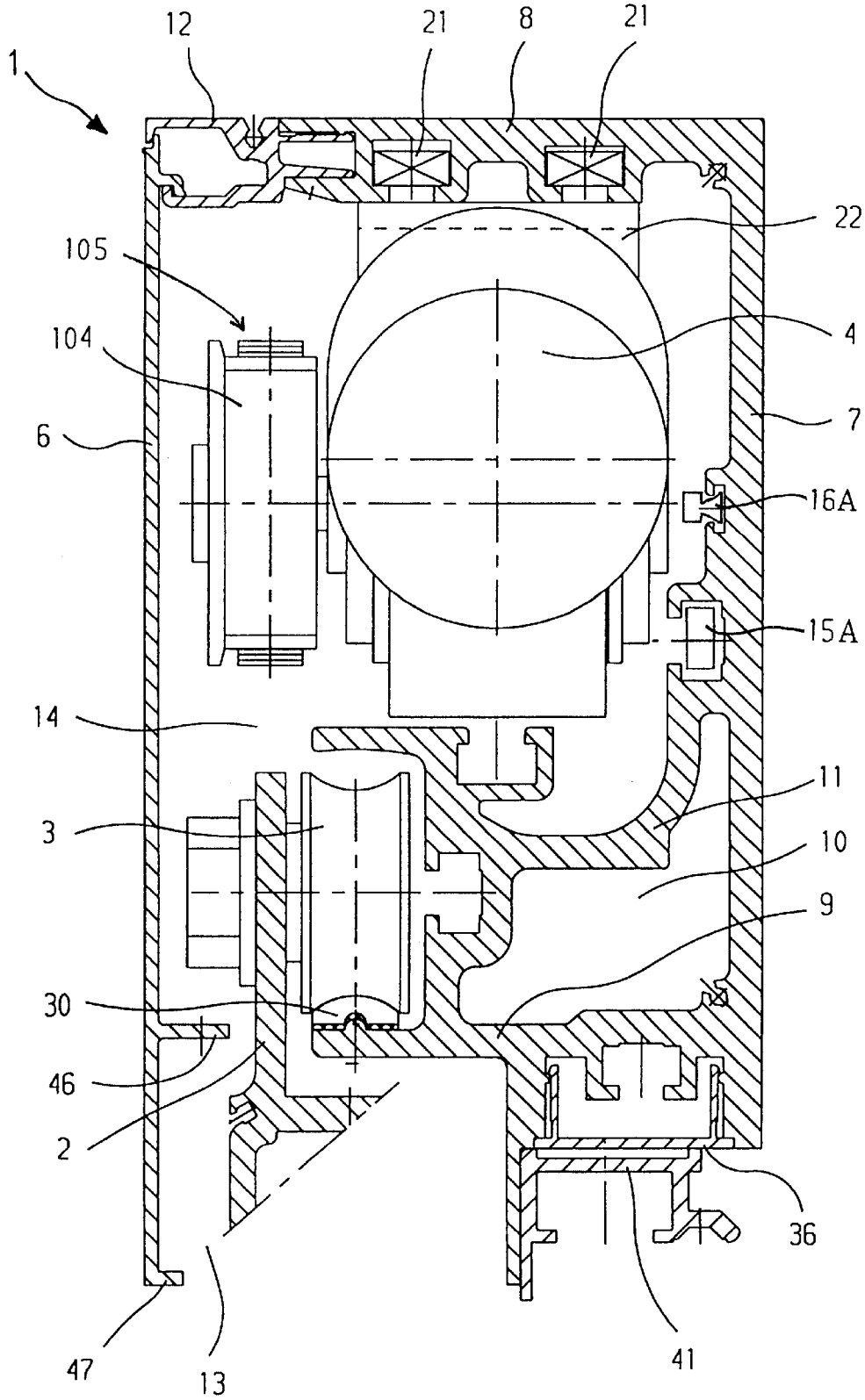
FIG. 1A is another sectional view through a partly equipped housing.

FIG. 1A shows a snap-in element 15A within mounting groove 15 and a snap-in element 16A within mounting groove 16.

Figure 2A:
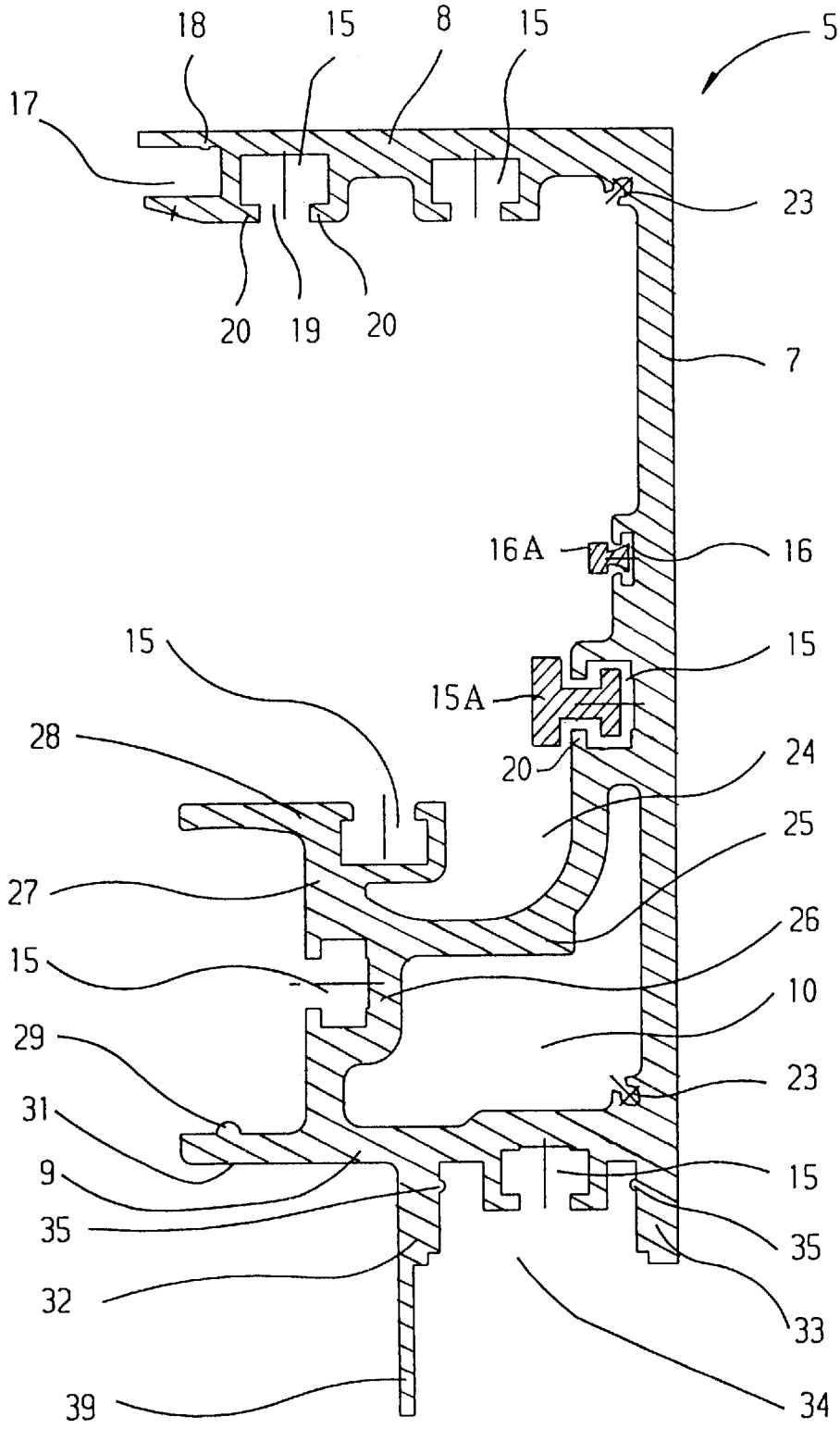
FIG. 2A is another sectional view through an unequipped housing like the one illustrated in FIG. 1A.
Figure 3:
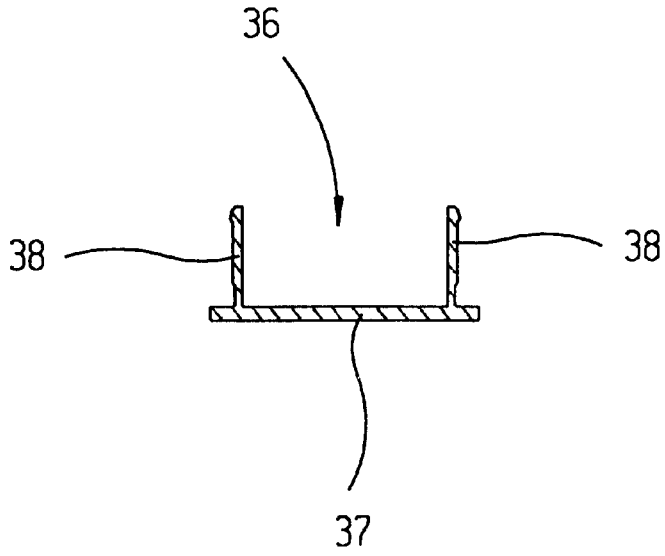
FIG. 3 is a detail of the cover profile illustrated in FIG. 1.
Figure 4:
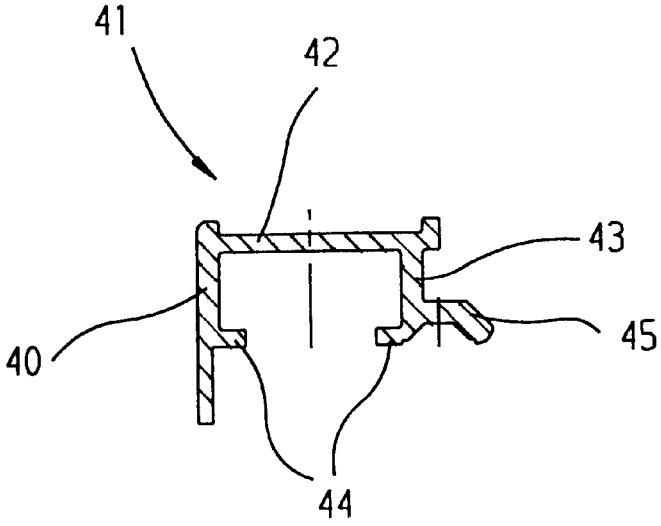
FIG. 4 is a detail of the U-profile illustrated in FIG. 1.

FIG. 2A shows a snap-in element 15A within mounting groove 15 and a snap-in element 16A within mounting groove 16.

Figure 5:
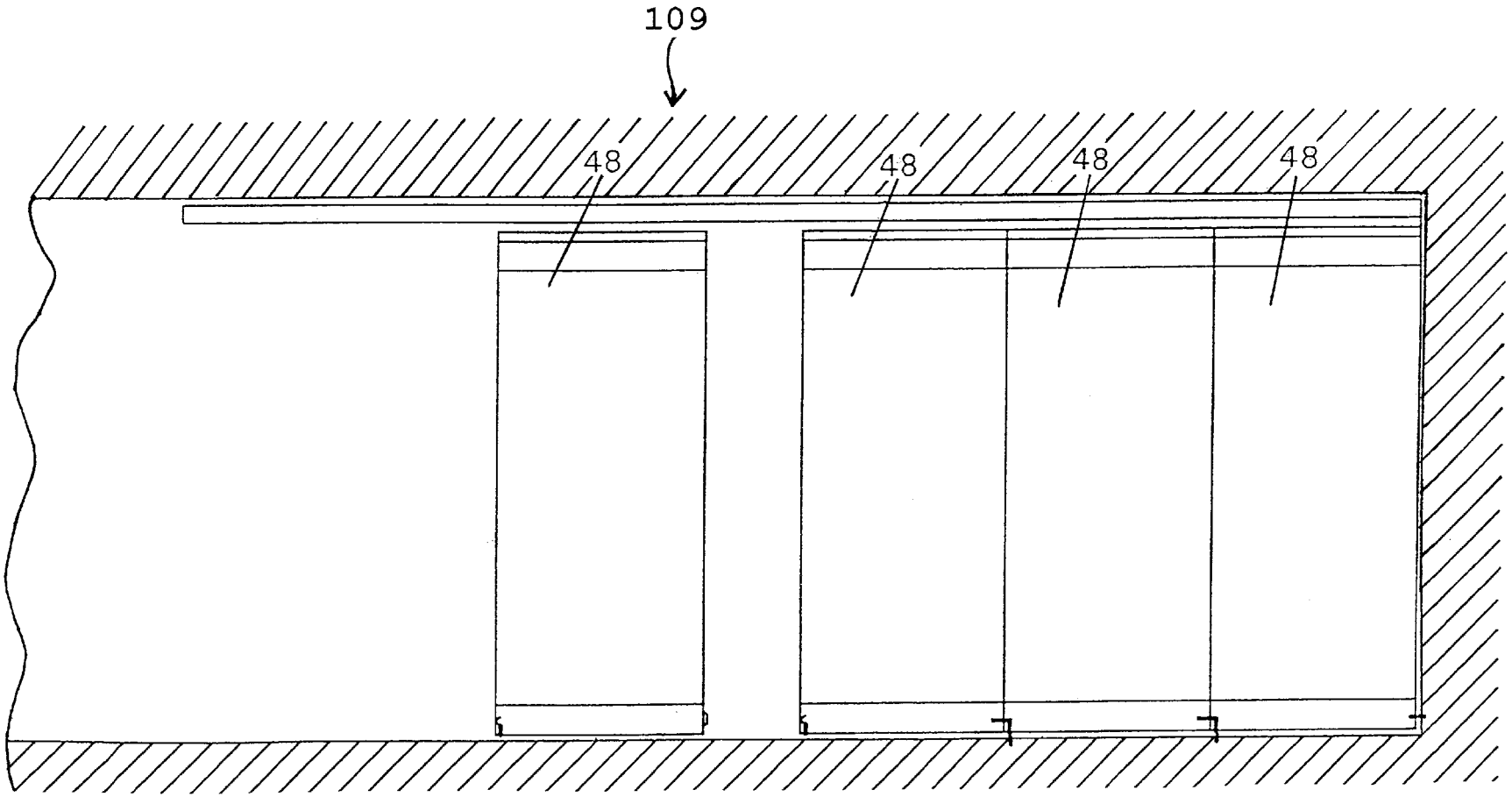
FIG. 5 is a view of a sliding panel system.

FIG. 5 shows a sliding panel system with panels 48 disposed in a building structure 109.

In one possible embodiment of the present invention, as shown in FIGS. 1 and 1A, the drive unit or mechanism 4 is operatively connected to a pinion 104, which is engaged with a toothed belt 105. The drive mechanism 4 drives the pinion 104 to move the partitions.

Figure 6:
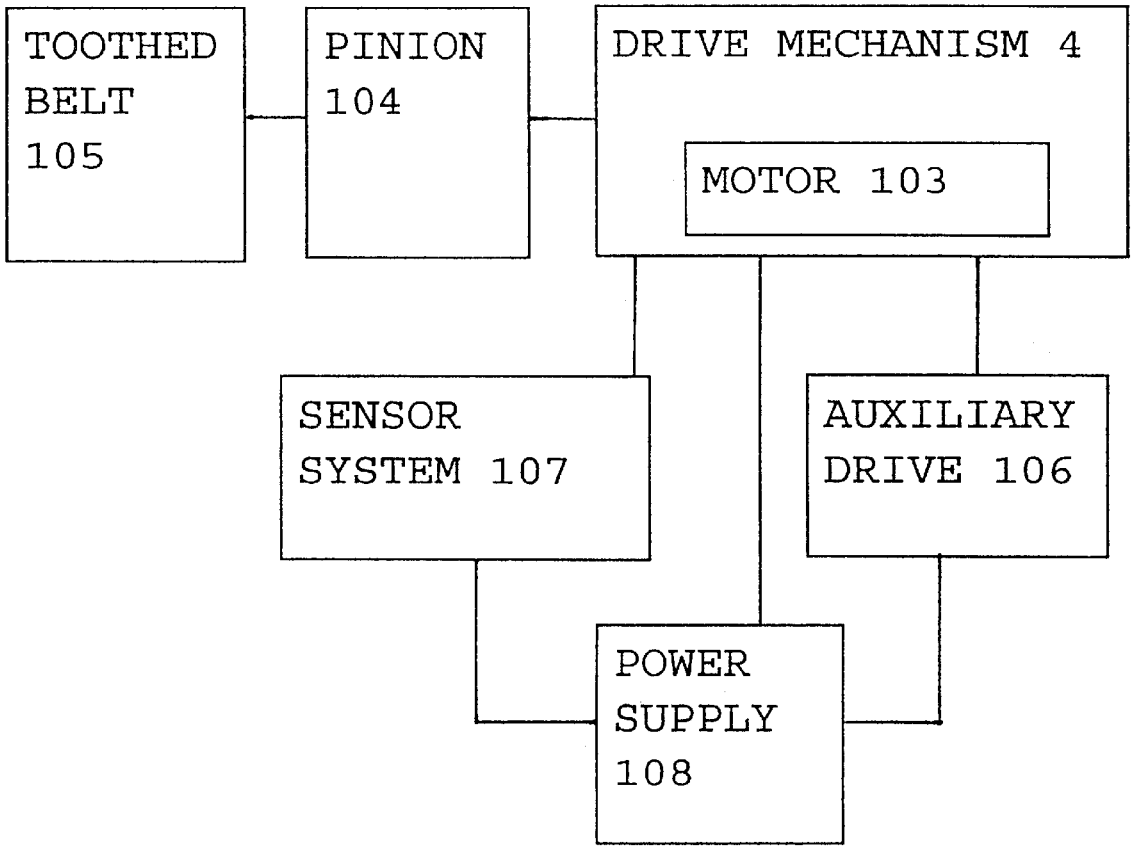
FIG. 6 is a block diagram showing components of a movable partition system according to at least one embodiment of the present invention.

FIG. 6 shows a block diagram showing components of a movable partition system according to at least one possible embodiment of the present invention. The drive mechanism 4 comprises a motor 103 to provide power to move the pinion 104, which is connected to the toothed belt 105. An auxiliary drive 106 provides auxiliary drive force for the movable partition system. A sensor system 107 is operatively connected to the drive mechanism 4 to sense a location of at least one partition element along a guide rail. A power supply 108 is also connected to the drive mechanism 4, the sensor system 107 and the auxiliary drive 106 to supply power to these components.

One feature of the invention resides broadly in a housing, in particular for automatic drive systems of horizontally movable elements, whereby the housing (1) is used in particular to hold mechanical, electrical and electronic components such as running devices (2, 3), suspension devices for movable elements, drive units (4) consisting of power transmission means, coupling, motor and displacement sensing devices, auxiliary drives, open-loop/closed-loop control systems, power supply, sensors etc., characterized by the fact that the housing (1) consists of a C-shaped transom profile (5) which can be closed by means of a closing profile (6) to realize a housing interior (14) and on which a support leg (11) is realized in one piece, thereby forming a cavity (10).

Another feature of the invention resides broadly in a housing characterized by the fact that the transom profile (5) has a longitudinal leg (7), to which transverse legs (8, 9) are connected at right angles on the upper and lower ends, whereby the support leg (11) is realized between the longitudinal leg (7) and the lower transverse leg (9).

Yet another feature of the invention resides broadly in a housing characterized by the fact that the support leg (11) is stepped and has a horizontal leg segment (25) and a vertical leg segment (26).

Still another feature of the invention resides broadly in a housing characterized by the fact that the support leg (11) forms a closable channel (24).

A further feature of the invention resides broadly in a housing characterized by the fact that shaped onto the support leg (11) is a vertical extension (27) that ends in a cross strut (28) that is extended toward both sides.

Another feature of the invention resides broadly in a housing, characterized by the fact that undercut mounting grooves (15, 16) are realized on the extension (27), the support leg (11), the transverse legs (8, 9) and/or the longitudinal leg (7).

Yet another feature of the invention resides broadly in a housing characterized by the fact that in the upper transverse leg (8), there are two mounting grooves (15) which are at some distance from each other.

Still another feature of the invention resides broadly in a housing characterized by the fact that the closing profile (6) is located on the upper transverse profile (8).

A further feature of the invention resides broadly in a housing characterized by the fact that on the upper transverse leg (8), a chamber (17) is realized for the locking attachment of an adapter profile (12), whereby the closing profile (6) is located on the adapter profile (12).

Another feature of the invention resides broadly in a housing characterized by the fact that a running profile (30) can be positively fastened on the bottom transverse leg (9).

Yet another feature of the invention resides broadly in a housing characterized by the fact that on the underside lower transverse leg (9), between webs (32, 33), there is an accessory channel (34), in which a mounting groove is realized.

Still another feature of the invention resides broadly in a housing characterized by the fact that the accessory channel (34) can be closed positively in an interlocking manner by a cover profile (36), whereby the cover profile (36) consists of a cover (37) and two elastically deflectable locking arms (38) which project at right angles.

A further feature of the invention resides broadly in a housing characterized by the fact that the web (32) has an extension (39), on which a U-shaped profile (41) can be located, which profile can be fastened to the lower transverse leg (9).

Another feature of the invention resides broadly in a housing characterized by the fact that the U-shaped profile (41) consists of a transverse partition (42) and two legs (40, 43) that project from it at right angles, whereby the legs (40, 43) each have inwardly bent edges (44) and the leg (43) has an outside projection (45).

Yet another feature of the invention resides broadly in a housing characterized by the fact that bolt channels (23) are formed between the longitudinal leg (7) and each of the transverse legs (8, 9).

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one emodiment is described herein.

The corresponding foreign patent publication application, namely, Federal Republic of Germany Patent Application No.199 62 074.1, filed on Dec. 21, 1999, having inventor Andreas FINKE, as well as its published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The invention as described hereinabove in the context of the preferred embodiments is not to be taken as limited to all of the provide details thereof, since modifications and variations thereof m be made without departing from the spirit and scope of the invention.

AT LEAST PARTIAL NOMENCLATURE

1 Housing
2 Truck
3 Roller
4 Drive unit
5 Transom profile
6 Closing profile
7 Longitudinal leg
8 Transverse leg
9 Transverse leg
10 Cavity
11 Support leg
12 Adapter profile
13 Slot
14 Interior of housing
15 Mounting groove
16 Mounting groove
17 Chamber
18 Fin
19 Opening
20 Projection
21 Square-head bolt
22 Mounting bracket
23 Bolt channel
24 Channel
25 Horizontal leg segment
26 Vertical leg segment
27 Extension
28 Cross strut
29 Rib
30 Running profile
31 Underside
32 Web
33 Web
34 Accessory channel
35 Rib
36 Cover profile
37 Cover
38 Locking arm
39 Extension
40 Leg
41 U-shaped profile
42 Transverse partition
42 Leg
43 Edge
44 Projection
45 Transverse web
46 Transverse web

What is claimed is:

1. An automatic movable partition system comprising:

at least one partition element comprising a panel support structure and a panel;

said panel being configured and disposed to hang from said panel support structure;

a housing comprising an extruded alloy material to minimize weight of said housing and having a minimized cross-sectional profile;

said housing having a hollowed interior housing components of said automatic movable partition system, said components comprising:

said panel support structure;

said panel support structure comprising a roller;

at least one drive mechanism comprising a motor, a pinion and a toothed belt to supply force to move said at least one partition element on said guide rail;

an auxiliary drive to supply auxiliary force;

a sensor system to sense a location of said at least one partition element and to provide sensor signals to control operation of said at least one drive mechanism; and a power supply to supply power to said at least one drive mechanism, said sensor system, and said auxiliary drive;

said housing being configured to be mounted on a building structure;

said housing comprising a cover frame and a one-piece base frame;

said cover frame being removably connected to said base frame to enclose the interior of said housing and to permit access to the interior of said housing; and said base frame comprising:

an elongated portion being disposed vertically and having a first end and a second end opposite said first end;

a first leg being disposed horizontally and connected at a right angle to said first end of said vertical elongated portion;

a second leg being disposed horizontally and connected at a right angle to said second end of said vertical elongated portion;

said vertical elongated portion, said horizontal first leg, and said horizontal second leg having a profile being substantially C-shaped in cross-section;

a support leg being disposed between and connected to said vertical elongated portion and said horizontal second leg to form a structure having a cavity;

said support leg comprising a first end portion being connected to said vertical elongated portion and a second end portion being connected to said horizontal second leg;

the connection between said first end portion of said support leg and said vertical elongated portion being disposed a predetermined distance vertically away from the connection of said horizontal second leg and said vertical elongated portion, and the connection between said second end portion of said support leg and said horizontal second leg being disposed a predetermined distance horizontally from the connection of said horizontal second leg and said vertical elongated portion;

said structure having said cavity being configured to maximize stability and torsional stiffness of said base frame and to maximize available space in the interior of said housing to permit the housing of said components of said automatic movable partition system;

said first end portion of said support leg is disposed at a right angle to said vertical elongated portion;

said second end portion of said support leg is disposed at a right angle to said horizontal second leg; and said support leg comprises:

a curved, first section connected to and generally disposed transverse to said first end portion of said support leg;

a second section connected to and extending horizontally away from said first section of said support leg;

a third section connected to and disposed transverse to said second section of said support leg;

a fourth section connected to and disposed transverse to said third section of said support leg; and said fourth section is connected to and disposed transverse to said second end portion of said support leg.

2. The automatic partition system according to claim 1, wherein:

said second section and said third section of said support leg form a step shape;

said first section and said second section of said support leg form a channel on a side of the support leg opposite the cavity;

said support leg further comprises:

a fifth section that is connected to and extends vertically from the connection of said second section and said third section of said support leg; and a sixth section that is connected to and disposed transverse to said fifth section of said support leg such that said sixth section extends horizontally away from said fifth section of said support leg in two directions;

each of said support leg, said horizontal first leg, said horizontal second leg, and said vertical elongated portion, comprise at least one undercut groove;

said at least one undercut groove of said horizontal first leg comprises two mounting grooves disposed a distance from each other;

said cover frame is connected to said base frame on said horizontal first leg;

said horizontal first leg comprises a locking slot;

said cover frame comprises an adapter piece inserted into and locked in said locking slot;

said cover frame comprises a cover panel removably connected to said adapter piece and disposed vertically;

a guide rail is formed by said support leg and said horizontal second leg and comprises a running surface on which said roller rolls, which running surface is fastened to said horizontal second leg;

said horizontal second leg comprises a first web and a second web that extend vertically away from a side of said horizontal second leg facing away from said cavity;

said webs are disposed to form an accessory channel;

said at least one undercut groove of said horizontal second leg comprises a mounting groove disposed in said accessory channel;

said housing further comprises a cover piece comprising a cover section and two elastically deflectable locking arms which project at right angles to said cover section;

said accessory channel is configured to be closed positively in an interlocking manner by said cover piece;

said first web has an extending portion, on which extending portion a U-shaped piece can be located;

said U-shaped piece comprises a transverse portion and first and second projecting legs that project from said transverse portion at right angles;

each of said projecting legs has an inwardly bent edge;

said first projecting leg has an outside projection that projects transverse to said first projecting leg; and bolt channels are formed between said vertical elongated portion and each of said first and second legs of said base frame.

3. In an automatic movable partition system, which automatic movable partition system comprises at least one partition element having a panel support structure and a panel hanging from the panel support structure, a housing, said housing comprising:

a hollowed interior being configured to house components of the automatic movable partition system, said components comprising said panel support structure, a roller to permit movement of said panel support structure, at least one drive mechanism to supply a force to move said panel comprising a motor, a pinion and a toothed belt, an auxiliary drive to supply an auxiliary force to move said panel, a sensor system to sense a location of said panel support structure and to provide sensor signals to control operation of said drive mechanism, and a power supply to supply power to said drive mechanism, said sensor system, and said auxiliary drive;

a cover frame;

a one-piece base frame being configured to mount said housing on a building structure;

said cover frame being configured to be removably connected to said base frame to enclose the interior of said housing and to permit access to the interior of said housing; and said base frame comprising:

an elongated portion being disposed vertically upon installation and having a first end and a second end opposite said first end;

a first leg being disposed horizontally upon installation and connected at a right angle to said first end of said vertical elongated portion;

a second leg being disposed horizontally upon installation and connected at a right angle to said second end of said vertical elongated portion;

said vertical elongated portion, said horizontal first leg, and said horizontal second leg having a profile being substantially C-shaped in cross-section;

a support leg being disposed between and connected to said vertical elongated portion and said horizontal second leg to form a structure having a cavity;

said support leg comprising a first end portion being connected to said vertical elongated portion and a second end portion being connected to said horizontal second leg;

the connection between said first end portion of said support leg and said vertical elongated portion being disposed a predetermined distance vertically away from the connection of said horizontal second leg and said vertical elongated portion, and the connection between said second end portion of said support leg and said horizontal second leg being disposed a predetermined distance horizontally away from the connection of said horizontal second leg and said vertical elongated portion;

said structure having said cavity being configured to maximize stability and torsional stiffness of said base frame and to maximize available space in the interior of said housing to permit the housing of said components of said automatic movable partition system;

said first end portion of said support leg is disposed at a right angle to said vertical elongated portion;

said second end portion of said support leg is disposed at a right angle to said horizontal second leg; and said support leg comprises:

a curved, first section connected to and disposed generally transverse to said first end portion of said support leg;

a second section connected to and extending horizontally away from said first section of said support leg;

a third section connected to and disposed transverse to said second section of said support leg;

a fourth section connected to and disposed transverse to said third section of said support leg; and said fourth section is connected to and disposed transverse to said second end portion of said support leg.

4. The housing in said automatic movable partition system according to claim 3, wherein:

said second section and said third section of said support leg form a step shape;

said first section and said second section of said support leg form a channel on a side of the support leg opposite the cavity;

said support leg further comprises:

a fifth section that is connected to and extends vertically from the connection of said second section and said third section of said support leg; and a sixth section that is connected to and disposed transverse to said fifth section of said support leg such that said sixth section extends horizontally away from said fifth section of said support leg in two directions;

each of said support leg, said horizontal first leg, said horizontal second leg, and said vertical elongated portion comprise at least one undercut groove;

said at least one undercut groove of said horizontal first leg comprises two mounting grooves disposed a distance from each other;

said cover frame is connected to said base frame on said horizontal first leg;

said horizontal first leg comprises a locking slot;

said cover frame comprises an adapter piece configured to be inserted into and locked in said locking slot;

said cover frame comprises a cover panel configured to be removably connected to said adapter piece and to be disposed vertically upon installation;

said horizontal second leg comprises a running surface on which said roller for said panel support structure can roll;

said horizontal second leg comprises a first web and a second web that extend vertically upon installation away from a side of said horizontal second leg facing away from said cavity;

said webs are disposed to form an accessory channel;

said at least one undercut groove of said horizontal second leg comprises a mounting groove disposed in said accessory channel;

said housing further comprises a cover piece comprising a cover section and two elastically deflectable locking arms which project at right angles to said cover section;

said accessory channel is configured to be closed positively in an interlocking manner by said cover piece;

said first web has an extending portion, on which extending portion a U-shaped piece can be located;

said U-shaped piece comprises a transverse portion and first and second projecting leg that project from said transverse portion at right angles;

each of said projecting legs has an inwardly bent edge;

said first projecting leg has an outside projection that projects transverse to said first projecting leg; and bolt channels are formed between said vertical elongated portion and each of said first and second horizontal legs of said base frame.

5. A kit for an automatic movable partition system, said kit comprising:

a housing being configured to be mounted on a building structure;

said housing comprising:

a cover frame;

a one-piece base frame;

said cover frame being configured to be removably connected to said base frame to permit access to an interior of said housing and to enclose the interior of said housing for enclosing components of the automatic movable partition system;

said base frame comprising:

an elongated portion being configured to be disposed vertically upon installation and having a first end and a second end opposite said first end;

a first leg being configured to be disposed horizontally upon installation and connected at a right angle to said first end of said vertical elongated portion;

a second leg being configured to be disposed horizontally upon installation and connected at a right angle to said second end of said vertical elongated portion;

said vertical elongated portion, said horizontal first leg, and said horizontal second leg having a profile being substantially C-shaped in cross-section;

a support leg being disposed between and connected too said vertical elongated portion and said horizontal second leg to form a structure having a cavity;

said support leg comprising a first end portion being connected to said vertical elongated portion and a second end portion being connected to said horizontal second leg;

the connection between said first end portion of said support leg and said vertical elongated portion being disposed a predetermined distance vertically away from the connection of said horizontal second leg and said vertical elongated portion, and the connection between said second end portion of said support leg and said horizontal second leg being disposed a predetermined distance horizontally away from the connection of said horizontal second leg and said vertical elongated portion;

said structure having said cavity being configured to maximize stability and torsional stiffness of said base frame and to maximize available space in the interior of said housing to permit the housing of said components of the automatic movable partition system;

said first end portion of said support leg is disposed at a right angle to said vertical elongated portion;

said second end portion of said support leg is disposed at a right angle to said horizontal second leg; and said support leg comprises a curved, first section connected to and disposed generally transverse to said first end portion of said support leg.

6. The kit according to claim 5, wherein said support leg comprises a second section connected to and extending horizontally away from said first section of said support leg.

7. The kit according to claim 6, wherein said support leg comprises a third section connected to and disposed transverse to said second section of said support leg.

8. The kit according to claim 7, wherein said support leg comprise a fourth section connected to and disposed transverse to said third section of said support leg.

9. The kit according to claim 8, wherein said fourth section is connected to and disposed transverse to said second end portion of said support leg.

10. The kit according to claim 9, wherein said second section and said third section of said support leg form a step shape.

11. The kit according to claim 10, wherein said first section and said second section of said support leg form a channel on a side of the support leg opposite the cavity.

12. The kit according to claim 11, wherein said support leg further comprises:

a fifth section that is connected to and extends vertically from the connection of said second section and said third section of said support leg; and a sixth section that is connected to and disposed transverse to said fifth section of said support leg such that said sixth section extends horizontally away from said fifth section of said support leg in toe directions.

13. The kit according to 12, wherein:

said cover frame is configured to be connected to said base frame on said horizontal first leg;

said horizontal first leg comprises a locking slot; and said cover frame comprises an adapter piece configured to be inserted into and locked in said locking slot.

14. The kit according to claim 13, wherein:

said cover frame comprises a cover panel configured to be removably connected to said adapter piece and configured to be disposed vertically upon installation; and said horizontal second leg comprises a running surface for a roller of the automatic movable partition system.

15. The kit according to claim 14, wherein:

each of said support leg, said horizontal first leg, said horizontal second leg, and said vertical elongated portion comprise at least one undercut groove;

said at least one undercut groove of said horizontal first leg comprises two mounting grooves disposed a distance from each other;

said horizontal second leg comprises a first web and a second web that extend vertically upon installation away from a side of said horizontal second leg facing away from said cavity;

said webs are disposed to form an accessory channel;

said at least one undercut groove of said horizontal second leg comprises a mounting groove disposed in said accessory channel;

said kit further comprises a cover piece comprising a cover section and two elastically deflectable locking arms which project at right angles to said cover section;

said accessory channel is configured to be closed positively in an interlocking manner by said cover piece;

said kit further comprises a U-shaped piece;

said first web has an extending portion;

said U-shaped piece is configured to be located on said extending portion;

said U-shaped piece comprises a transverse portion and first and second projecting legs that project from said transverse portion at right angles;

each of said projecting legs has an inwardly bent edge;

said first projecting leg has an outside projection that projects transverse to said first projecting leg; and bolt channels are formed between said vertical elongated portion and each of said first and second horizontal legs of said base frame.

* * * * *

UNITED STATES PATENT AND TRADEMARK OFFICE

CERTIFICATE OF CORRECTION

PATENT NO. : 6,516,566 B2
DATED : February 11, 2003
INVENTOR(S) : Andreas Finke

It is certified that error appears in the above-identified patent and that said Letters Patent is hereby corrected as shown below:

Column 1,
Line 55, after “running” delete “,”.

Column 7,
Line 65, after “the”, delete “provide” and insert -- provided --.
Line 66, after “thereof”, delete “m” and insert -- may --.

Column 8,
Line 44, before “Leg”, delete “42” and insert -- 43 --.
Line 45, before “Edge”, delete “43” and insert -- 44 --.
Line 46, before “Projection”, delete “44” and insert -- 45 --.
Line 47, before “Transverse” delete “45” and insert -- 46 --.
Line 48, before “Transverse” delete “46” and insert -- 47 --.

Column 12,
Line 55, after “projecting”, delete “leg” and insert -- legs --.

Column 14,
Line 13, after “in”, delete “toe” and insert -- two --.

Signed and Sealed this

Twenty-ninth Day of July, 2003

JAMES E. ROGAN
*Director of the United States Patent and Trademark Office*